United States Patent [19]

Klinker et al.

[11] Patent Number: 4,699,596

[45] Date of Patent: Oct. 13, 1987

[54] MODIFIED JET SKI NOZZLE

[76] Inventors: Ronald D. Klinker, 223 N. Willow Spring Rd., Orange, Calif. 92669; Franklin D. Clark, 1984 N. Lake Mead Cir., Orange, Calif. 92667; Patricia K. Klinker, 223 N. Willow Springs Rd., Orange, Calif. 92669

[21] Appl. No.: 14,451

[22] Filed: Feb. 13, 1987

[51] Int. Cl.[4] ..... B63H 11/117

[52] U.S. Cl. ..... 440/39; 60/222; 440/43; 441/71

[58] Field of Search ..... 440/38, 39, 40, 43, 440/67; 60/222; 441/71; 114/270

[56] References Cited

U.S. PATENT DOCUMENTS

| | | | |
|---|---|---|---|
| Re. 30,978 | 6/1982 | Jacobson | 114/270 |
| 1,714,917 | 5/1929 | Martin | 440/67 |
| 2,024,274 | 12/1935 | Campini | 244/18 |
| 2,931,134 | 5/1960 | Nevitt | 114/288 |
| 2,983,508 | 5/1961 | Modine | 114/270 X |
| 3,077,616 | 2/1963 | Billingham | 441/71 |
| 3,226,033 | 12/1965 | Cochran | 440/43 |
| 3,229,312 | 1/1966 | Smith | 441/71 |
| 4,138,963 | 2/1979 | Thompson | 60/222 |
| 4,509,927 | 4/1985 | Ikeda | 114/288 |

FOREIGN PATENT DOCUMENTS

| | | | |
|---|---|---|---|
| 1513548 | 2/1968 | France | 440/67 |
| 278253 | 10/1927 | United Kingdom | 440/40 |

*Primary Examiner*—Sherman D. Basinger
*Attorney, Agent, or Firm*—F. Eugene Logan

[57] ABSTRACT

This invention is a nozzle system for use on a water craft and in particular a water craft such as a jet ski. A jet ski is a small engine powered surface water craft, usually designed for one person usage, and generally having a small aft deck suitable for standing on by the user. Heretofore, nozzles used on jet skis were pivotally mounted and were used solely to propel or to propel and steer the craft in the water. This invention is for a modified nozzle that additionally produces a small but substantial secondary jet of water directed upwards that breaks through the surface of the water behind the craft and produces a "rooster tail" effect which adds to the safety, excitement and pleasure of the user and produces a spectacular water display that is enjoyed by those observing the craft and its user in action. The rooster tail produced by this invention can be seen by other larger water craft operators long before the relatively small jet ski would be noticed thereby enhancing the safety of the jet ski operator and enhancing water safety. The improved visibility provided by this invention to jet skis also enhances surveilance by on shore personnel such as lifeguards and others concerned with the safety of the jet ski operator and others in the water.

20 Claims, 14 Drawing Figures

MODIFIED JET SKI NOZZLE

BACKGROUND OF THE INVENTION

This invention is a modified nozzle for a water craft used for producing a secondary jet of water which is thrust upwardly at a velocity sufficient to break through the surface of the water and form a "rooster tail" behind the water craft as such craft travels along the surface of the water. The modified nozzle is particularly useful for a water craft such as a jet ski or an aquatic vehicle as described in U.S. Pat. Nos. 3,826,220 and Re. 30,978.

SUMMARY OF THE INVENTION

This invention is a nozzle means for attaching to a water craft for simultaneously forming two separate water jets which are directed in two different directions. The nozzle means is particularly suited for water craft frequently referred to as jet skis such as the aquatic vehicle disclosed in U.S. Pat. Nos. Re. 30,978 and 3,826,220 which are hereby incorporated herein by reference. The nozzle of this invention, while transforming most of the high velocity water entering the nozzle into a high velocity primary jet of water for propelling the water craft, diverts a minor amount of water entering the nozzle into an upwardly directed secondary jet of water which has a different direction than the primary jet of water. The secondary jet of water has sufficient velocity to break through the surface of water behind the water craft and form a "rooster tail" of water. The formation of the rooster tail provides added safety and excitement to the user and creates a spectacular effect as the boat is made to twist and turn through the water. Since jet skis are relatively small water craft, their presence is often not apparent to operators of other larger water craft. The rooster tail of water produced by this invention can be seen long before the jet ski itself is seen thereby adding to the safety of jet ski operator by enhancing jet ski visibility. The rooster tail is formed by a novel side stream forming means which is a part of the modified nozzle of this invention. In one embodiment of this invention the side stream forming means may be readily deactivated without removal of the nozzle from the water craft or the water craft from the water thereby allowing the nozzle to produce, if desired, just the primary jet of water used for propelling and the water craft.

Accordingly, there is provided by this invention a nozzle means for attaching, preferably pivotally attaching, to a water craft, and for simultaneously forming two separate water jets directed in two different directions. The nozzle means comprises a main body having a main inlet and a principal outlet. The longitudinal axis of the principal outlet is preferably approximately parallel to, and approximately coincident with, the longitudinal axis of the main inlet. The main inlet is for receiving into the main body of the nozzle means, when the nozzle means is in use, water from a high velocity water stream producing source. The principal outlet is for forming and directing, when said nozzle means is in use, at least a major portion of such high velocity water entering the nozzle means through the main inlet into a high velocity primary jet of water which is subsequently discharged from the principal outlet in a direction approximately parallel to the longitudinal axis of the principal outlet and away from the nozzle means, such that such primary jet of water propels such water craft to which the nozzle means is attached through the water.

The nozzle means further comprises a novel side stream forming means having a channel, a secondary outlet and ramp means. The channel is longitudinally disposed in the inner upper rear portion of the nozzle means. The top boundary of the channel is formed by the upper inside surface of the nozzle means. The channel has a channel inlet at one end thereof and a channel outlet at the other end thereof. The channel inlet and outlet are transversely disposed inside the nozzle means and the channel inlet is disposed between the main inlet and the channel outlet. The open traverse cross-sectional area of the channel is relatively small compared to the open traverse cross-sectional area of the nozzle means at a point proximate to but upstream of the channel inlet so that only a minor portion of the water entering the nozzle means through the main inlet enters the channel. The longitudinal centerline of the channel outlet is above and approximately parallel to the longitudinal axis of the principal outlet.

The secondary outlet is located in the upper rear part of the nozzle means that contains the channel.

The ramp means comprises a ramp which is mounted, preferably pivotally mounted, to the nozzle means proximate to the secondary outlet. In the embodiment in which the ramp is pivotally mounted to the main body of the nozzle means, the ramp has an upper surface and a leading edge. The ramp is rotatable into the channel through the secondary outlet so that the leading edge of the ramp abuts the inner bottom surface of the channel and the upper surface of the ramp forms an upwardly inclined surface in the channel leading directly to the secondary outlet. The upwardly inclined surface is operative for forming a secondary jet of water having a substantial upwardly directed component relative to the axis of the principal outlet such that the direction of the thus formed secondary jet of water, on an average basis, is substantially different from the direction, on an average basis, of the primary jet of water. The ramp means is also for forming, when positioned so that the leading edge of the ramp abuts the inner bottom surface of the channel, a barrier in the channel between the channel inlet and the channel outlet which is operative for retarding the flow of water to the channel outlet, such that when the leading edge of the ramp is in the channel and the nozzle means is in use, the flow of water into the channel forces the leading edge of the ramp downward so that the leading edge abuts the inner bottom surface of the channel. In one embodiment the ramp is also rotatable out of the channel and into a "raised position" sufficiently proximate to the secondary outlet that the ramp is operative for forming a barrier proximate to the secondary outlet. When in the raised position the ramp is operative, when the nozzle means is in use, for retarding the flow of water through the secondary outlet and for allowing water in the channel to discharge therefrom through the channel outlet.

In a further embodiment the nozzle means comprises fastening means (i) for holding the ramp in the raised position so that the ramp forms such a barrier to the flow of water to and through the secondary outlet, and (ii) alternatively for preventing the ramp from being positioned in the raised position.

In a further embodiment the open cross-sectional area of the channel is approximately uniform throughout the longitudinal length of the channel. In another embodiment the channel outlet is proximate to the principal outlet. In another embodiment the ramp has an undersurface and when the ramp is in the raised position the undersurface is approximately in line with the inner or alternately the outer surface of the nozzle means proximate to the secondary outlet. It is preferable to have the undersurface of the ramp in line with the inner surface of the nozzle proximate to said undersurface to minimize the disturbance to the flow of water from the principal outlet and channel outlet. In a still further embodiment the ramp means also comprises stop means for preventing the ramp from being raised above the horizontal position thereby, for example, preventing the ramp from pointing straight up.

In yet another embodiment the channel inlet and outlet are traversely disposed in the nozzle means to the longitudinal axis thereof. In another embodiment the open traverse cross-sectional area of the channel, on an average basis, is approximately between about 3 and 20% of the open traverse cross-sectional area of the nozzle means at a point immediately upstream of the channel inlet or alternately at the throat of the nozzle. In another embodiment the upwardly-inclined surface formed by the ramp, when the leading edge thereof abuts the bottom of the channel, is at an angle of from about 20 degrees to about 80 degrees, as measured on a counterclockwise basis, from the longitudinal axis of the nozzle means when the main inlet is on the left and the principal axis is on the right. This angle is referred to herein as the "ramp angle". Preferably the ramp angle is from about 40 to about 75 degrees and especially preferably from about 50 to about 70 degrees.

In one embodiment, when the ramp is in the raised position so as to form a barrier to the flow of water through the secondary outlet, the undersurface of the ramp is approximately in line with the inner upper surface of the nozzle means proximate to the secondary outlet thereby minimizing the disturbance caused by the secondary outlet to the flow of water through the nozzle means when the ramp is in its raised position.

In another embodiment of the nozzle means the channel is bounded on one side by a right vertical planar wall, on the opposing side by a left vertical planar wall which is parallel to the right vertical planar wall thereof, and on the bottom by a horizontal planar wall which is perpendicular to the vertical planar walls. In one embodiment the secondary outlet is bounded on one side by a right vertical planar face, on the opposing side by a left vertical planar face which is parallel to the right vertical planar face thereof, and a traverse foreface perpendicular to the vertical planar faces thereof. In one embodiment the ramp has a right vertical planar side, a left vertical planar side which is parallel to the right vertical planar side thereof, and a leading edge which is perpendicular to the vertical planar sides thereof. In still another embodiment the traverse width of the ramp, as measured by the distance between the vertical planar sides thereof, is slightly smaller than the open traverse width of the channel, as measured by the distance between the inside surfaces of the vertical planar walls thereof thereby forming a right and a left clearance distance between the vertical planar sides of the ramp and the inside vertical planar walls of the channel. In still another embodiment the traverse width of the ramp is also slightly smaller than the open traverse width of the secondary outlet as measured by the distance between the vertical planar faces thereof thereby forming a right and a left clearance distance between the vertical planar sides of the ramp and the vertical planar faces of the secondary outlet, so that when the ramp is in its raised position the leading edge thereof is proximate to the traverse foreface of the secondary outlet.

In another embodiment of the nozzle means the right vertical planar face of the secondary outlet is an extension of the right vertical planar wall of the channel and the left vertical planar face of the secondary outlet is an extension of the left vertical planar wall.

In another embodiment the nozzle means has a throat, the throat has a diameter, and the ratio of the open traverse width of the channel to the throat diameter is from about 0.1 to about 0.4, preferably from about 0.15 to about 0.3, and especially preferably from about 0.2 to about 0.25. In one embodiment the ratio of average height of the channel upstream from the secondary outlet to the throat diameter is from about 0.1 to about 0.4, preferably from about 0.15 to about 0.3, and especially preferably from about 0.2 to about 0.25. In yet another embodiment the ratio of the inside or open traverse area of the channel as determined by the inside or open traverse width and inside or open height of the channel to the inside or open throat area is from about 0.03 to about 0.2, preferably from about 0.5 to about 0.1, and especially preferably from about 0.06 to about 0.07. In still another embodiment the nozzle means has an overall longitudinal length, and the ratio of the overall longitudinal length to the throat diameter is from about 1.5 to about 3, preferably from about 1.7 to about 2.6, and especially preferably from about 2 to about 2.4. In one embodiment the channel has an overall longitudinal length as measured from the channel inlet to the channel outlet, and the ratio of the overall longitudinal length of the channel to the overall longitudinal length of the nozzle means is from about 0.3 to about 0.8, preferably from about 0.4 to about 0.6, and especially preferably from about 0.46 to about 0.56.

In one embodiment the open-to-water-flow or "open" cross-sectional area of the interior of the nozzle means, except for the presence of the channel, is approximately circular beginning at the main inlet through to the principal outlet. In another embodiment the open-to-water-flow or "open" cross-sectional area of the channel, except for the opening created by the secondary outlet, is approximately rectangular and preferably approximately square beginning at the channel inlet to the channel outlet.

In general the secondary outlet of the modified nozzle means of this invention, when mounted to the water craft, must extend beyond the aft end of the water craft so that the upwardly directed secondary jet of water does not impinge on the hull of the water craft.

The modified nozzle os this invention can be used to retrofit existing jet ski type water craft by replacing nozzle installed by the manufacturer of the jet ski with the modified nozzle of this invention. Therefore the mounting brackets and the like of the modified nozzle must be adapted to fit the particular water craft to which the modified nozzle is to be attached.

DESCRIPTION OF THE PREFERRED EMBODIMENT

Figure 9:
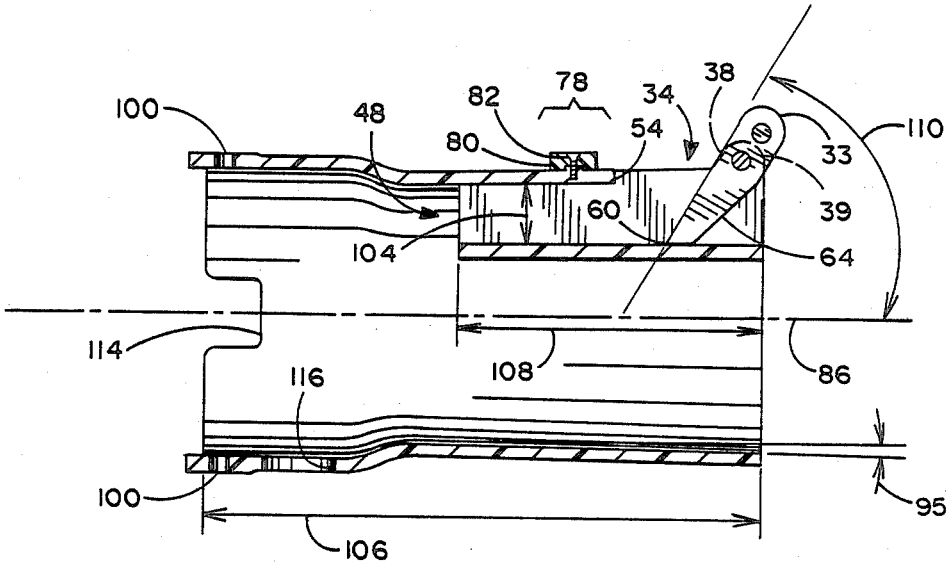
FIG. 9 is an elevational cross-sectional view taken through line 9—9 of FIG. 7, showing the ramp in its lowered position blocking the channel outlet and the secondary outlet unobstructed.
Figure 10:
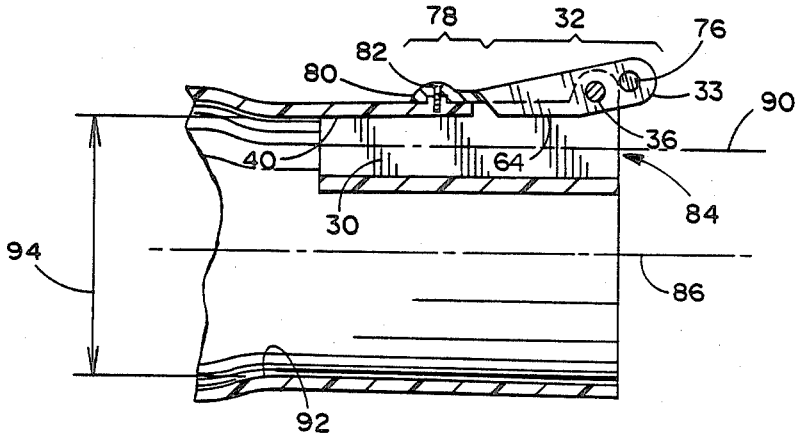
FIG. 10 is an elevational cross-sectional view of the rear part of the nozzle similar to FIG. 9 but showing the ramp in its raised position blocking the secondary outlet and the channel outlet unobstructed.

Referring to the drawings, FIGS. 1 to 8 illustrate nozzle means 20 which comprises main body 22, principal outlet 24, main inlet 26, and side stream forming means 28. Means 28 comprises channel 30, ramp means 32 and secondary outlet 34 as best seen in FIGS. 9 and 10. Ramp means 32 comprises ramp 33, pin 36 and bearing means 38. Ramp 32 is pivotally connected by pin 36 to bearing means 38. Bearing means 38 is attached to, or preferably is an integral part of, main body 22.

Preferably channel 30 has top boundary 40 formed from a part of the upper inside surface of the nozzle means. The channel is bounded by right vertical planar wall 42 and left vertical planar wall 44 as seen from the outlet of the nozzle in FIG. 7; the right and left orientation designation as used herein being shown in FIG. 7. The channel is bounded on the bottom by horizontal planar wall 46. Preferably walls 42 and 44 are parallel to each other and vertically oriented. Preferably wall 46 is horizontal and perpendicular to walls 42 and 44. Walls 42, 44 and 46 and bounary part 40 of the upper rear inside wall of the nozzle means form channel inlet 48.

Secondary outlet 34 is formed in the upper rear part of the nozzle means and is approximately a rectangular shaped opening therein which is bounded by right vertical planar face 50, left vertical planar face 52, and traverse foreface 54. Face 52 is preferably parallel to face 50 and foreface 54 perpendicular to faces 50 and 52. Preferably face 50 is the vertical extension of wall 42 and face 52 is the vertical extension of wall 44 so that there are no ridges or other obstructions to interfere with the rotation of ramp 33 through outlet 34 and in channel 30.

Figure 1:
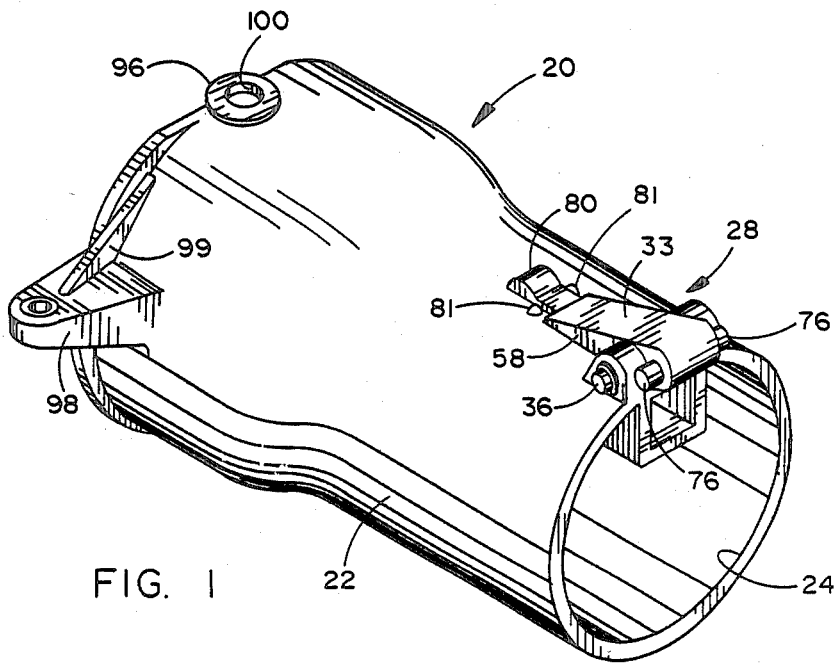
FIG. 1 is a perspective view of one embodiment of our modified nozzle for pivotally mounting to a water craft as seen from a top-side-rear view showing the ramp in its raised position with the channel outlet unobstructed and the ramp blocking the secondary outlet.
Figure 2:
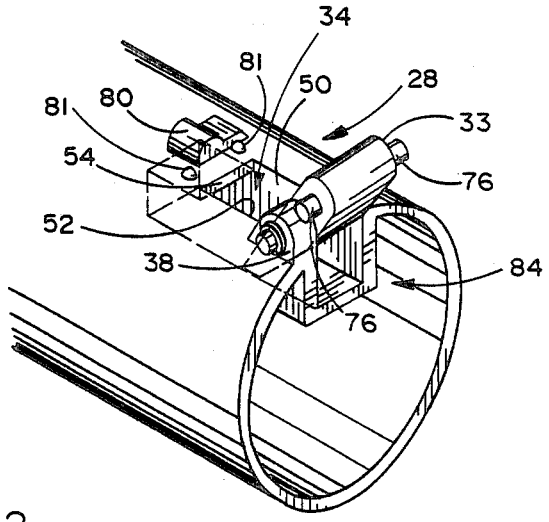
FIG. 2 is a perspective view of the rear part of the nozzle means of FIG. 1 showing the ramp means in its lowered position in the channel with the secondary outlet unobstructed and the ramp blocking the channel outlet.
Figure 3:
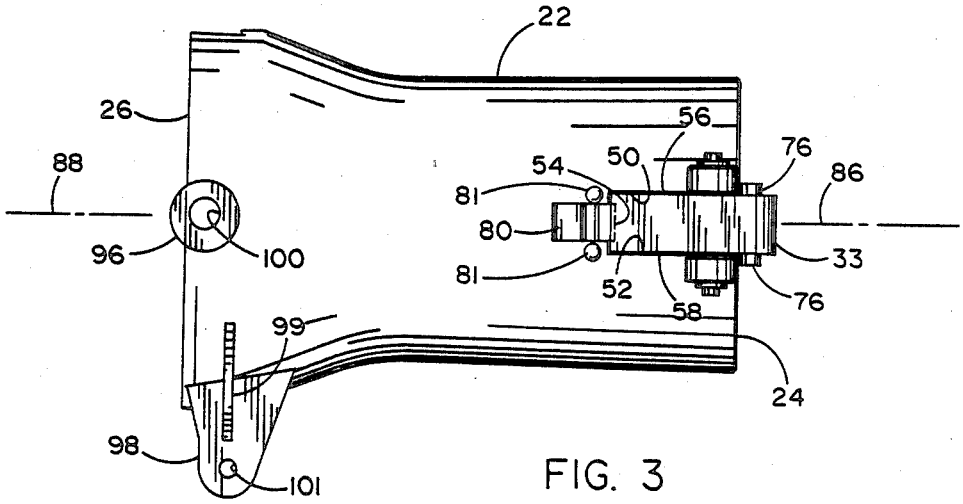
FIG. 3 is a top plan view of the nozzle of FIG. 1 showing the ramp in its raised position.
Figure 4:
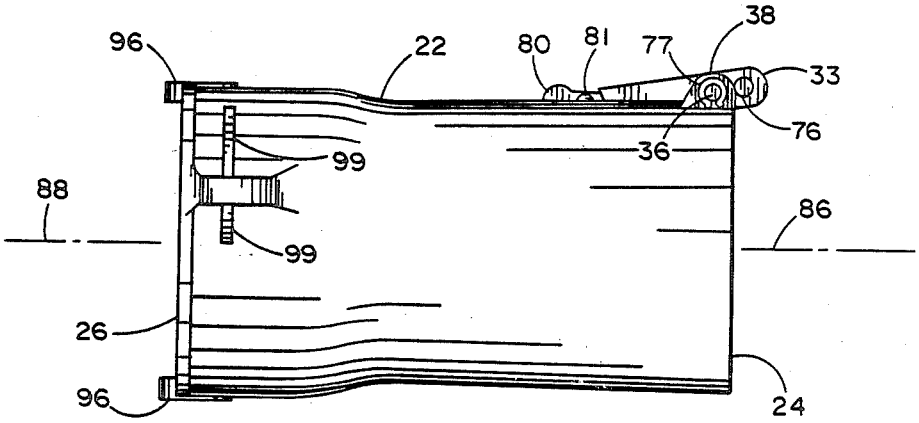
FIG. 4 is a right side elevational view of the nozzle of FIG. 1 showing the ramp in its raised position.
Figure 5:
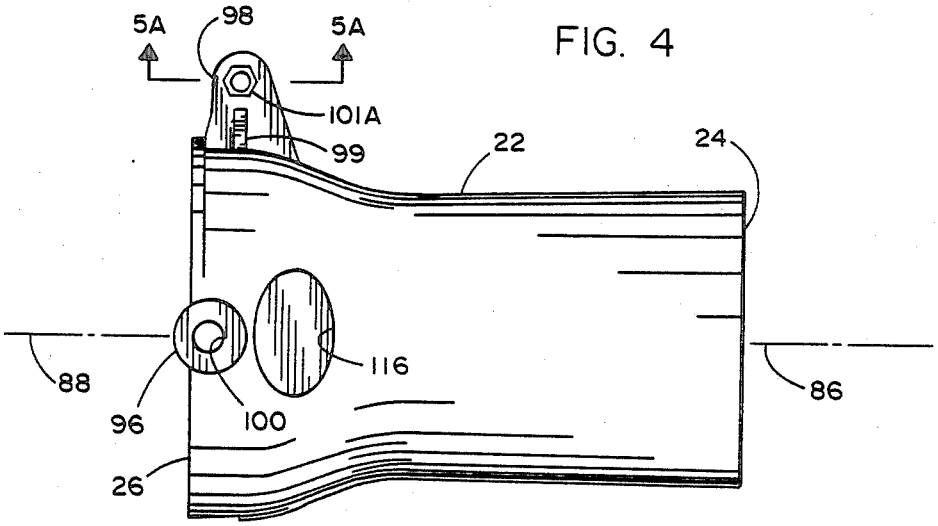
FIG. 5 is a bottom plan view of the nozzle of FIG. 1.
Figure 11:
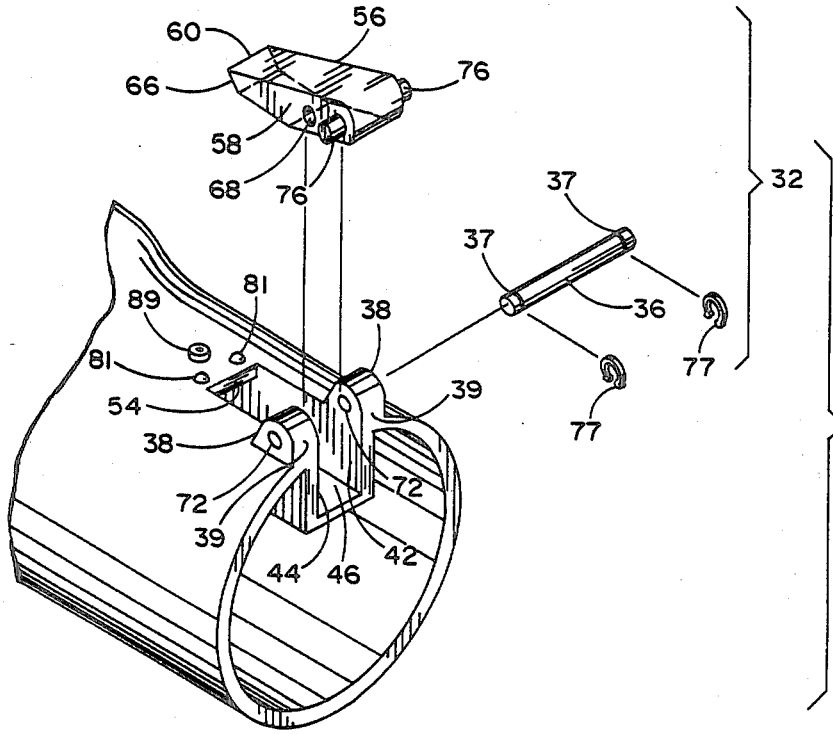
FIG. 11 is an explosive view, similar to FIG. 1, showing how the ramp means is assembled in the nozzle means.
Figure 12:
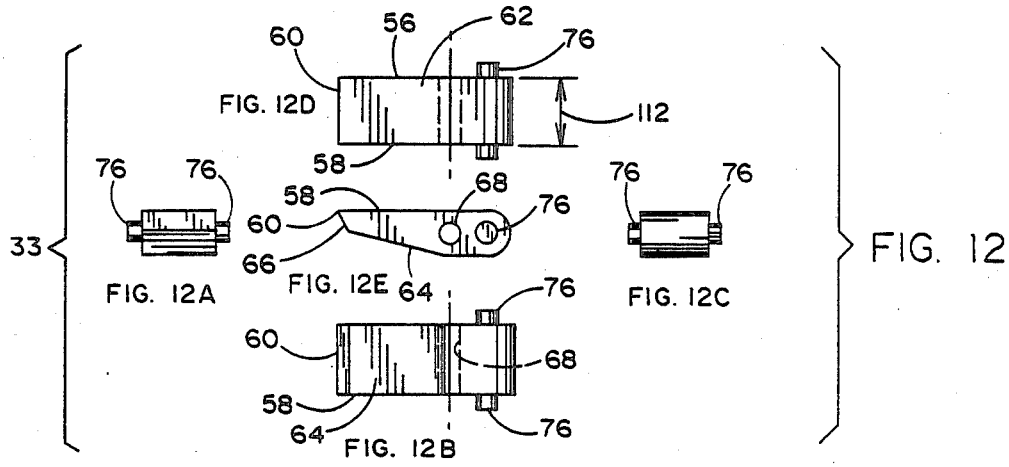
FIG. 12 consists of detailed plan, elevational and end views A, B, C, D and E of ramp 33.

Ramp 33 has approximately a rectangular longitudinal cross section and is bounded by right vertical planar side 56, left vertical planar side 58, leading edge 60, upper surface 62 and undersurface 64 as shown in FIG. 12. Preferably leading edge 60 is formed by chamfer 66 and upper surface 62. Chamfer 66 is such that the ramp will lay flat against bottom wall 46 of the channel. Ramp 33 also contains bore 68. Pin 36 is inserted through bore 72 in right bearing means 38, bore 68 in ramp 33 and bore 72 in left bearing means 38. In order to prevent ramp 33 from being rotated to a straight up position or above the horizontal position, ramp 33 contains stop extensions 76 which extend a short distance beyond vertical sides 56 and 58 of ramp 33. Stop extensions 76 abut rear surface 39 of bearing means 38 as ramp 33 is rotated through secondary outlet 34 to the horizontal or raised position as shown in FIG. 10. Further rotation upward of leading edge 60 of ramp 33 is prevented by stop extensions 76 bearing against rear surfaces 39 of bearing means 38. After assembly of the parts, pin 36 is held in place by C spring clamps 77 which are snapped into grooves 37 of pin 36 to prevent the pin from inadvertently working free from bearing means 38. FIG. 11 is an explosive view, similar to FIG. 1, showing how ramp 33 is pivotally attached to bearings 38 with pin 36 and how C spring clamps 77 are mounted on pin 36. Locking lever 80 has been omitted from FIG. 11 merely to more clearly show the details of ramp means 32 and some details of locking means 78.

Figure 13:
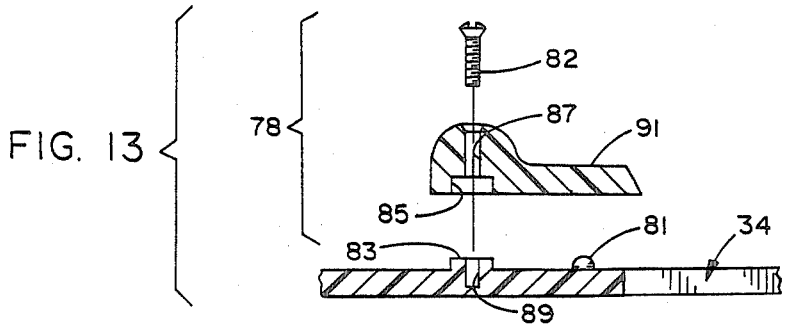
FIG. 13 is an enlarged explosive view showing details of the attachment of the locking lever to the main body of the nozzle means.

Locking means 78 comprises locking lever 80, screw 82, lock extensions 81 and pivot extensions 83 as shown in FIG. 13. Locking lever 80 contains cylindrical recess 85 adapted to fit on cylindrical pivot extension 83, and bore 87 for receiving screw 82. Lock extensions 81 and pivot extension 83 preferably are integral parts of the one piece construction of main body 22. Pivot extension 83 contains blind bore 89 for receiving screw 82. Lever 80 is preferably made from a plastic material and has section 91 which is relatively thin and deflectable. When lever 80 is in its locked position it is positioned between the pair of lock extensions 81. To unlock lever 80, thin section 91 therefore is deflected upwards as the lever is rotated about pivot extension 83 so that thin section 91 clears lock extension 81. Lever 80 may be rotated either clockwise or counterclockwise. Pivot extension 83 is located on main body 22 just slightly upstream of secondary outlet 34. Lever 80 is rotatably attached to main body 22 by screw 82. When in its locked position a part of lever 80 extends over traverse foreface 54 and, when ramp 33 is in the raised position, under leading edge 60 of ramp 33 abutting surface 66 thereof thereby preventing ramp 33 from being inadvertently positioned in channel 30. Ramp 33 and secondary outlet 34 are designed so that when ramp 33 is in its raised position it will block the flow of water from channel 30 through outlet 34. Thus when ramp 33 is in the raised position, as shown in FIG. 10, the majority of the water that enters channel 30 through inlet 48, will be discharged through channel outlet 84. Slight leak of water between ramp 33 and outlet 34 can be tolerated and will not substantially effect the usefulness of the nozzle means.

Lever 80 can be rotated to allow ramp 33 to be lowered into channel 30. Lever 80 can be left in its unlocked position or rotated back to its "locked position" to prevent ramp 33 from being rotated to its elevated position.

In the lowered position leading edge 60 of ramp 33 rests on horizontal planar wall 46 of channel 30 as shown in FIG. 9. In the lowered ramp position, because of the small clearance between sides 56 and 58 of ramp 33 and walls 42 and 44 of channel 30, the majority of the water entering channel 30 through inlet 48, will be discharged through secondary outlet 34. Slight leak of water between ramp 33 and walls 42 and 44 will not substantially effect the usefulness of nozzle means 20.

Lever 80 is designed to snap over lock extension 81 and into its locked position with enough force that it cannot be inadvertently dislodged therefrom without deliberate effort.

Preferably longitudinal axis 86 of principal outlet 24 is parallel and coincident with longitudinal axis 88 of main inlet 26. Preferably longitudinal centerline 90 of channel 30 is parallel to longitudinal axis 86 of outlet means 24.

Nozzle means has throat 92 which has throat diameter 94 as shown in FIG. 10. Preferably nozzle outlet 24 diverges slightly from the throat diameter. A divergent of angle 95 of about 1 degree is preferred.

Figure 5A:
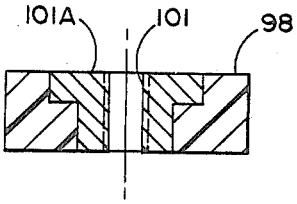
FIG. 5A is a detailed view of steering mount 98 taken through line 5A—5A of FIG. 5.
Figure 6:
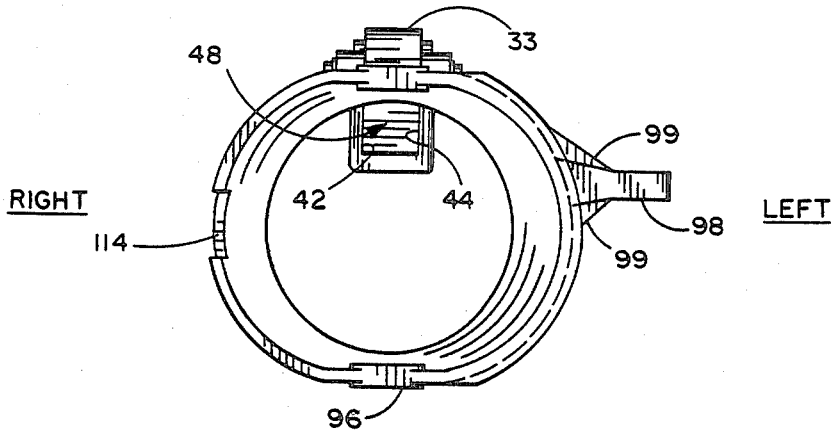
FIG. 6 is a front view of the nozzle of FIG. 1 with the ramp in its lowered position.

Nozzle means 20 also has mounts 96 containing bore 100 for pivotal attachment to a jet ski and bracket 98 containing bore 101 for attaching to the steering linkage or mechanism of the jet ski. Threaded bore 101 is preferably contained in bronze bushing 101A for added strength as shown in FIG. 5A. Operation of the steering linkage of the jet ski (not shown) causes nozzle means 20 to pivot about bores 100 thereby steering the water craft to the port or starboard as desired. Bracket 98 is provided with reenforcing fillets 99.

Preferably main body 22, walls 42, 44 and 46 of channel 30, bearings 38, lock extensions 81, pivot extension 83 mounts 96 and bracket 98 are constructed from a single piece of material. Preferably the single piece of material is a plastic and preferably a thermoplastic. A preferable thermoplastic is acrylonitrile-butadienne-styrene or "ABS". A preferable grade of ABS plastic material is ABS-648-4000 made by Monsanto Chemical Company. It is also preferable to make such single piece of material by molding such as injection or compression molding.

In one embodiment the throat diameter of the nozzle means is from about 3 to about 3.8 inches, and preferably from about 3.2 to about 3.6 inches. In another embodiment the overall length of the nozzle means is from about 5 to about 10 inches, and preferably from about 6 to about 8 inches. In one embodiment the overall length of the channel as determined by the lower surface thereof is from about 2 to about 6 inches, and preferably from about 3 to about 5 inches. In one embodiment the average channel height is from about 0.5 to about 1 inch, preferably about 0.6 to about 0.9 inches, and especially preferably from about 0.7 to about 0.8 inches. In a further embodiment the average channel width is from about 0.5 to about 1 inch, preferably about 0.6 to about 0.9 inches, and especially preferably from about 0.7 to about 0.8 inches. In still another embodiment the main body of the nozzle means is made of plastic and the plastic has a general thickness of from about 0.1 to about 0.3 inches, preferably from about 0.12 to about 0.2 inches, and especially preferably from about 0.14 to about 0.18 inches. In another embodiment both the main body and channel of the nozzle means is made from one piece of plastic and the plastic has a general thickness from about 0.1 to about 0.3 inches, and preferably from about 0.13 to about 0.24 inches, and especially preferably from about 0.15 to about 0.21 inches. By general thickness is meant the thickness of the main body of the nozzle where the thickness has not been increased for adaption to a bracket, fillet, mount or the like. Prefrably at bracket, fillet, mount or the like locations the thickness is increased to accommodate the increased structural duty required at such locations.

Design parameters for one embodiment are:

| Value | |
|---|---|
| | Ratio |
| 0.22 | Average open traverse width of channel (element 102) to Throat diameter (element 94) |
| 0.22 | Average open height of channel (element 104) to Throat diameter (element 94) |
| 0.65 | Average open traverse area of channel (i.e. element distance 102 × element distance 104) to Throat diameter (element 94) |
| 2.2 | Overall longitudinal length of nozzle means (element 106) to Throat diameter (element 94) |
| 1.1 | Overall longitudinal length of channel (element 108) to Throat diameter (element 94) |
| 0.5 | Overall longitudinal length of channel (element 108) to Overall longitudinal length of nozzle means (element 106) |
| | Angles |
| 0.5 to 2 | Angle in degrees of divergence of principal outlet nozzle (element 95) |
| 55 to 65 | Angle in degrees of upwardly inclined surface of lowered ramp (element 110) |

Figure 7:
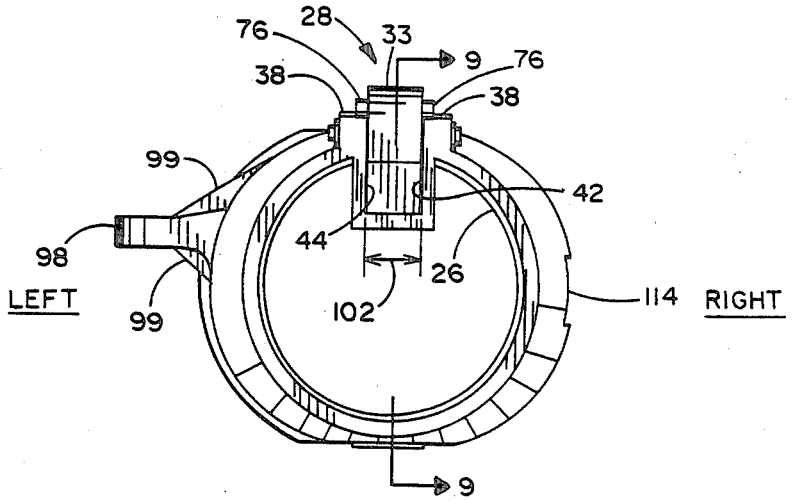
FIG. 7 is a rear view of the nozzle of FIG. 1 with the ramp in its lowered position.
Figure 8:
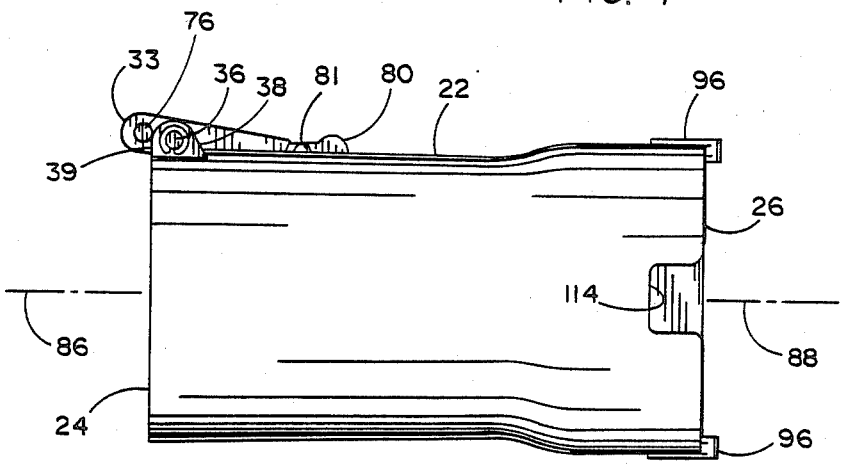
FIG. 8 is a left side elevational view of the nozzle of FIG. 1 with the ramp in its raised position.

Distance and angle elements referred to above are shown in FIGS. 7, 9, and 10.

In one embodiment useful for models 300, 440 and 550 Kawasaki Motor Corporation brand jet skis, the main body and channel are formed from a single piece of plastic, the main body, except for the channel, has a generally circular open-to-water-flow or "open" cross section, the channel has a generally square open-to-water-flow or "open" cross section, the throat diameter or distance element 94 is about 3.4 inches, the overall longitudinal nozzle length, or distance element 106, is about 7.3 inches, the overall longitudinal channel length, or distance element 108, is about 3.7 inches, the general thickness of the main body and channel vertical walls, except for mounts, brackets, bearings and other reinforced areas, is about 0.16 inches, and the thickness of the horizontal planar wall forming the bottom of the channel is about 0.2 inches.

In one embodiment the clearance between the vertical planar walls of the channel and the vertical planar sides of the ramp are from about 0.010 to about 0.020 inches.

In one embodiment the plastic is selected from the group consisting of cellulose acetate butyrates, nylon, polycarbonates, polyethylenes, methylmethacrylates, polypropylenes, polystyrenes, polystyrene-acrylonitriles, polytrifluorochloro ethylene, polyvinylchlorides, vinylchloride acetates, acrylonitrile-butadiene-styrenes, acetals, and alkyd resins. An especially preferred plastic is an acrylonitrile-butadiene-styrene or ABS.

In one embodiment in the main body of the nozzle means is made of plastic the plastic has a tensile strength of at least about 6000 pounds per square inch (6000 psi), a yield stress of at least about 3000 psi, and a notched Izod impact strength of at least 1.5 foot-pounds per inch (1.5 ft-lbs/in).

The figures are drawn approximately to scale. Therefore dimensions of interest can be readily determined from the drawings.

In general it is to be understood however that values outside the particular set of specifications described herein can be used. The nozzle means, however, must be adaptable for mounting to the particular jet ski or water craft of interest.

Slot or notch 114 is adapted for receiving a tube for aspirating water by venturi action from the jet ski. Other openings, notches and the like, such as elliptic opening 116 can be included to accommodate particular features, functions or devices not necessarily related to the formation of a rooster tail.

Although jet ski water craft which can be retrofitted with this modified nozzle are made by Kawasaki Motor Corporation, it is to be understood that the modified nozzle of this invention can be used on any surface water craft using a nozzle for forming a primary jet of water for propelling the water craft through the water.

It is to be understood that the present disclosure and embodiment of this invention described herein are for purposes of illustraion and example and that modifications and improvements may be made thereto without departing from the spirit of the invention or from the scope of the claims. The claims, therefore, are to be accorded a range of equivalents commensurate in scope with the advances made over the art.

What is claimed is:

1. Nozzle means for attaching to a water craft and for simultaneously forming two separate water jets directed in two different directions, said nozzle means comprising:

a main body having a main inlet and a principal outlet, the longitudinal axis of said principal outlet being approximately parallel to, and approximately coincident with, the longitudinal axis of said main inlet, said main inlet for receiving into said main body of said nozzle means, when said nozzle means is in use, water from a high velocity water stream producing source, said principal outlet for forming and directing, when said nozzle means is in use, at least a major portion of such high velocity water entering said nozzle means through said main inlet into a high velocity primary jet of water discharged from said principal outlet in a direction approximately parallel to the longitudinal axis of said principal outlet and away from said nozzle means, such that such primary jet of water propels such water craft to which said nozzle means is attached through the water, side stream forming means having a channel, a secondary outlet and ramp means, said channel being longitudinally disposed in the inner upper rear portion of said nozzle means, the top boundary of said channel being formed by the upper inside surface of said nozzle means, said channel having a channel inlet at one end of said channel and a channel outlet at the other end of said channel, said channel inlet and outlet being transversely disposed inside said nozzle means, said channel inlet being disposed between said main inlet and said channel outlet, the open traverse cross-sectional area of said channel being relatively small compared to the open traverse cross-sectional area of said nozzle means at a point proximate to but upstream of said channel inlet so that only a minor portion of such water entering said nozzle means through said main inlet enters said channel, the longitudinal centerline of said channel outlet being above and approximately parallel to the longitudinal axis of said principal outlet, said secondary outlet being in the upper rear part of said nozzle means which contains said channel, said ramp means comprising a ramp which is pivotally mounted to said nozzle means proximate to said secondary outlet, said ramp having an upper surface and a leading edge, said ramp being rotatable into said channel through said secondary outlet so that said leading edge of said ramp abuts an inner bottom surface of said channel and said upper surface of said ramp forms an upwardly inclined surface in said channel leading directly to said secondary outlet, said upwardly inclined surface being operative for forming a secondary jet of water having a substantial upwardly directed component relative to the axis of said principal outlet and such that the direction of such thus formed secondary jet of water, on an average basis, is substantially different from the direction, on an average basis, of such primary jet of water, said ramp means also forming, when positioned so that said leading edge of said ramp abuts the inner bottom surface of said channel, a barrier in said channel between said channel inlet and said channel outlet operative for retarding the flow of water to said channel outlet, such that when said leading edge of said ramp is in said channel and said nozzle means is in use, the flow of water into said channel forces said leading edge of said ramp downward so that said leading edge abuts the inner bottom surface of said channel, said ramp also being rotatable out of said channel and into a raised position sufficiently proximate to said secondary outlet so that said ramp is operative for forming a barrier proximate to said secondary outlet operative, when said nozzle means is in use, for retarding the flow of water through said secondary outlet and for allowing water in said channel to discharge therefrom through said channel outlet, and fastening means (i) for holding said ramp in said riased position so that said ramp forms said barrier to the flow of water through said secondary outlet, and (ii) alternatively for preventing said ramp from being positioned in said raised position.

2. Nozzle means for attaching to a surface water craft and for simultaneously forming two separate water jets directed in two different directions, said nozzle means comprising:

a main body having a main inlet and a principal outlet, the longitudinal axis of said principal outlet being approximately parallel to, and approximately coincident with, the longitudinal axis of said main inlet, said main inlet for receiving into said main body of said nozzle means, when said nozzle means is in use, water from a high velocity water stream producing source, said principal outlet means for forming and directing, when said nozzle means is in use, at least a major portion of such high velocity water entering said nozzle means through said main inlet into a high velocity primary jet of water discharged from said principal outlet in a direction which, on an average basis, is approximately parallel to the longitudinal axis of said principal outlet and away from said nozzle means, such that such primary jet of water propels and steers such surface water craft to which said nozzle means is attached along the surface of the body of water in which such surface water craft is placed, side stream forming means having a channel, a secondary outlet and ramp means, said channel being longitudinally disposed in the inner upper rear portion of said nozzle means, the top boundary of said channel being formed by the upper inside surface of said nozzle means, said channel having a channel inlet at one end of said channel and a channel outlet at the other end of said channel, said channel inlet and outlet being transversely disposed inside said nozzle means, said channel inlet being disposed between said main inlet and said channel outlet, the open traverse cross-sectional area of said channel being approximately uniform and relatively small compared to the open traverse cross-sectional area of said nozzle means at a point proximate to but upstream of said channel inlet so that only a minor portion of such water entering said nozzle means through said main inlet enters said channel, the longitudinal centerline of said channel being above and approximately parallel to the longitudinal axis of said nozzle means, said channel outlet being proximate to said principal outlet, said secondary outlet being in the upper rear part of said nozzle means which contains said channel, and proximate to said principal outlet, said ramp means comprising a ramp which is pivotally mounted to said nozzle means proximate to said secondary outlet, said ramp having an upper surface, an under surface and a leading edge, said ramp being rotatable through said secondary outlet into said channel so that said leading edge of said ramp abuts an inner bottom surface of said channel and said upper surface of said ramp forms an upwardly inclined surface in said channel leading directly to said secondary outlet, said upwardly inclined surface being operative for forming and directing such water entering said channel into a secondary jet of water discharged through said secondary outlet in a direction having, on an average basis, a substantial upwardly directed component relative to the axis of said principal outlet and such that at least a substantial amount of such water is discharged by such secondary jet into the air behind such water craft, and further such that the direction of such secondary jet of water, on an average basis, is substantially different from the direction, on an average basis, of such primary jet of water, said ramp means also forming, when positioned so that said leading edge of said ramp abuts the inner bottom surface of said channel, a barrier in said channel between said channel inlet and said channel outlet operative for retarding the flow of water to said channel outlet, such that when said leading edge of said ramp is in said channel and said nozzle means is in use, the flow of water into said channel forces said leading edge of said ramp downward so that said leading edge abuts the inner bottom surface of said channel, said ramp also being rotatable out of said channel and into a raised position sufficiently proximate to said secondary outlet so that said ramp is operative for forming a barrier proximate to said secondary outlet operative, when said nozzle means is in use, for retarding the flow of water through said secondary outlet and for allowing water in said channel to discharge therefrom through said channel outlet, fastening means (i) for holding said ramp in said raised position so that said ramp forms said partial barrier to the flow of water from said channel through said secondary outlet, and (ii) alternatively for preventing said ramp from being positioned in said raised position, and stop means for preventing said ramp from being rotated above its raised position.

3. Nozzle means for attaching to a water craft and for simultaneously forming two separate water jets directed in two different directions, said nozzle means comprising:

a main body having a main inlet and a principal outlet, the longitudinal axis of said principal outlet being approximately parallel to, and approximately coincident with, the longitudinal axis of said main inlet, said main inlet for receiving into said main body of said nozzle means water from a high velocity source of water, said principal outlet for forming and directing a primary jet of water away from said nozzle means in a direction approximately parallel to the longitudinal axis of said principal outlet, side stream forming means having a channel, a secondary outlet and ramp means, said channel being longitudinally disposed in the inner upper rear portion of said nozzle means, the top boundary of said channel being formed by the upper inside surface of said nozzle means, said channel having a channel inlet at one end of said channel and a channel outlet at the other end of said channel traversely disposed in said nozzle means to the longitudinal axis thereof, said channel inlet being disposed between said main inlet and said channel outlet, the open traverse cross-sectional area of said channel being approximately uniform and between about 3 and about 20% of the open traverse cross-sectional area of said nozzle means at a point immediately upstream of said channel inlet, the longitudinal centerline of said channel outlet being above and approximately parallel to the longitudinal axis of said principal outlet, said secondary outlet being in the upper rear part of said nozzle means which contains said channel, said ramp means comprising a ramp which is pivotally mounted to said nozzle means proximate to said secondary outlet, said ramp having an upper surface and a leading edge, said ramp being rotatable through said secondary outlet into said channel so that said leading edge of said ramp abuts an inner bottom surface of said channel and said upper surface of said ramp forms an upwardly inclined surface in said channel leading directly to said secondary outlet, said upwardly inclined surface being at an angle of from about 20 degrees to about 70 degrees from the longitudinal axis of said nozzle means as measured on a counterclockwise basis when said main inlet is on the left and said principal outlet is on the right, said ramp means also forming, when positioned so that said leading edge of said ramp abuts the inner bottom surface of said channel, a barrier in said channel between said channel inlet and said channel outlet operative for retarding the flow of water to said channel outlet, such that when said leading edge of said ramp is in said channel and said nozzle means is in use, the flow of water into said channel forces said leading edge of said ramp downward against the inner bottom surface of said channel, said ramp, when positioned so that the leading edge thereof abuts the bottom surface of said channel, being operative for causing the major amount of water entering said channel inlet to be discharged from said channel through said secondary outlet, said ramp also being rotatable out of said channel and into a raised position in which said ramp is approximately in line with the upper body of said nozzle means at a point proximate to said secondary outlet and when said ramp is thusly positioned said ramp is operative for forming a barrier proximate to said secondary outlet for retarding the flow of water through said secondary outlet and for allowing water to be discharged from said channel through said channel outlet, and fastening means (i) for holding said ramp in said raised position so that said ramp forms said barrier to the flow of water through said secondary outlet while allowing the discharge of water from said channel outlet, and (ii) alternatively for preventing said ramp from being positioned in said raised position.

4. The nozzle means of claim 3 wherein said channel is bounded on one side by a right vertical planar wall, on the opposing side by a left vertical planar wall which is parallel to said right vertical planar wall thereof, and on the bottom by a horizontal planar wall which is perpendicular to said vertical planar walls, wherein said secondary outlet is bounded by one side by a right vertical planar face, on the opposing side by a left vertical planar face which is parallel to said right vertical planar face thereof, and a traverse foreface perpendicular to said vertical planar faces thereof, wherein said ramp has a right vertical planar side, a left vertical planar side which is parallel to said right vertical planar side thereof, and wherein said leading edge thereof is perpendicular to said vertical planar sides thereof, wherein the traverse width of said ramp as measured by the distance between said vertical planar sides thereof is slightly smaller than the open traverse width of said channel as measured by the distance between said vertical planar walls thereof thereby forming a right and a left clearance between said vertical planar sides of said ramp and said vertical planar walls of said channel, wherein the traverse width of said ramp is also slightly smaller than the open traverse width of said secondary outlet as measured by the distance between said vertical planar faces thereof thereby forming a right and a left clearance between said vertical planar sides of said ramp and said vertical planar faces of said secondary outlet, and wherein when said ramp is in said raised position the leading edge thereof is proximate to said traverse foreface of said secondary outlet.

5. The nozzle means of claim 4, wherein said right vertical planar face of said secondary outlet is an extension of said right vertical planar wall of said channel and said left vertical planar face of said secondary outlet is an extension of said left vertical planar wall.

6. The nozzle means of claim 3, wherein said nozzle means has a throat, said throat has a diameter, and the ratio of said open traverse width of said channel to said throat diameter is from about 0.1 to about 0.4.

7. The nozzle means of claim 3, wherein said nozzle means has a throat, said throat has a diameter, and the ratio of open height of said channel to said throat diameter is from about 0.1 to about 0.4.

8. The nozzle means of claim 3, wherein said nozzle means has a throat, and the ratio of the open traverse area of said channel as determined by the open traverse width and open height of said channel to the open throat area is from about 0.03 to about 0.2.

9. The nozzle means of claim 3, wherein said nozzle means has a throat and an overall longitudinal length, said throat has a diameter, and the ratio of said overall longitudinal length to said throat diameter is from about 1.5 to about 3.

10. The nozzle means of claim 3, wherein said nozzle means has an overall longitudinal length, said channel has an overall longitudinal length, and wherein the ratio of said overall longitudinal length of said channel to said overall longitudinal length of said nozzle means is from about 0.3 to about 0.8.

11. The nozzle means of claim 3, further comprising stop means for preventing said ramp means from being rotated above said raised position.

12. The nozzle means of claim 3 further comprising first means integral to said main body for pivotally mounting to said water craft, and second means integral to said main body for connecting to a steering means of said water craft.

13. The nozzle means of claim 3, wherein said main body and said channel are formed from a single piece of material.

14. The nozzle means of claim 13, wherein said single piece of material is a thermoplastic.

15. The nozzle means of claim 14, wherein said thermoplastic has a tensile strength of at least about 6000 psi, a yield stress of at least about 3000 psi, and a notched Izod impact strength of at least about 1.5 ft-lb/in.

16. The nozzle means of claim 13, wherein said single piece of material is produced by injection molding.

17. The nozzle means of claim 13, wherein said single piece of material is an acrylonitrile-butadienne-styrene.

18. The nozzle means of claim 3, further comprising a first means attached to said main body for pivotally mounting said main body to said water craft; and second means attached to said main body for connecting to a steering means of said water craft so that said nozzle means is operable for effecting the steering of said water craft; and wherein said main body, said channel, said first means and said second means are formed from a single piece of material.

19. The nozzle means of claim 18, wherein said single piece of material is a plastic and said single piece of material is produced from said plastic by injection molding.

20. The nozzle means of claim 19, wherein said plastic is selected from the group consisting of cellulose acetate butyrates, nylon, polycarbonates, polyethylenes, methylmethacrylates, polypropylenes, polystyrenes, polystyrene-acrylonitriles, polytrifluorochloro ethylene, polyvinylchlorides, vinylchloride acetates, acrylonitrile-butadiene-styrenes, acetals, and alkyd resins.

* * * * *